United States Patent [19]

Fowler

[11] 4,286,751

[45] Sep. 1, 1981

[54] HUMIDIFIER CONTROL

[75] Inventor: Thomas P. Fowler, Madison, Wis.

[73] Assignee: Research Products Corp., Madison, Wis.

[21] Appl. No.: 21,719

[22] Filed: Mar. 19, 1979

[51] Int. Cl.[3] ..... B01F 3/02; H02H 3/00

[52] U.S. Cl. ..... 236/44 R; 324/127; 336/175; 361/94

[58] Field of Search ..... 126/113; 236/44 R; 307/311; 361/178, 93, 94; 367/93; 336/175; 340/664; 324/126, 127; 335/204

[56] References Cited

U.S. PATENT DOCUMENTS

| | | | |
|---|---|---|---|
| 3,597,754 | 8/1971 | Lerner | 367/93 X |
| 3,840,176 | 10/1974 | Baysinger | 236/44 R |
| 3,934,239 | 1/1976 | Mason et al. | 340/664 |
| 4,071,824 | 1/1978 | Kernander et al. | 324/127 |
| 4,138,627 | 2/1979 | Camic | 340/664 X |
| 4,142,143 | 2/1979 | Daniel | 324/127 X |
| 4,163,271 | 7/1979 | Sturrock | 361/93 |
| 4,167,858 | 9/1979 | Kojima et al. | 62/126 |

OTHER PUBLICATIONS

Aprilaire Humidifier Model 110 Installation Instructions, Research Products Corporation, Madison, Wisconsin, 5/3/1977.

*Primary Examiner*—William E. Wayner
*Assistant Examiner*—Harry Tanner
*Attorney, Agent, or Firm*—Andrus, Sceales, Starke & Sawall

[57] ABSTRACT

The electrical energy flowing between a power source and a furnace blower motor is sensed for controlling the operation of a humidifier. A removable current sensor is connected without damaging or disfiguring the connecting lead being sensed. A solid state switch operatively connects the humidifier to a power source in response to the sensed current and is electrically isolated from the current sensor. The control circuit provides a time delay in the energization and the de-energization of the humidifier and is responsive to the current flow in the sensed lead.

10 Claims, 4 Drawing Figures

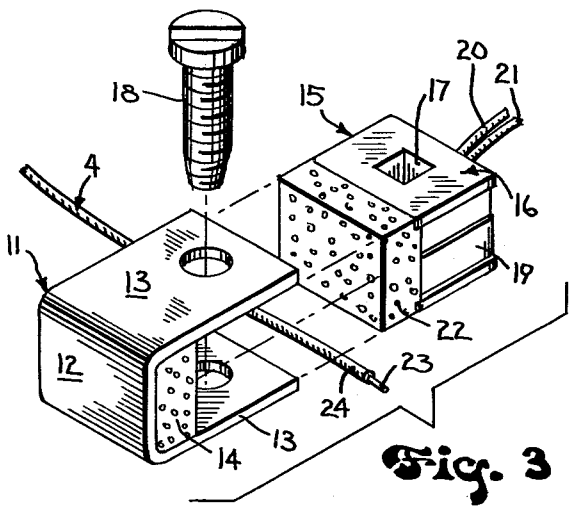
Fig. 1
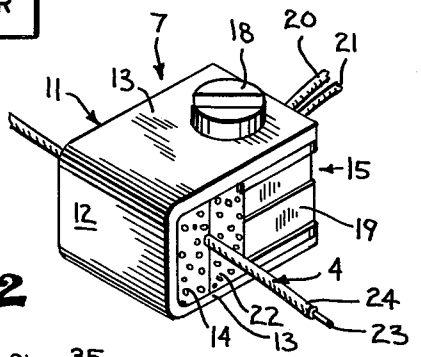
Fig. 2
Fig. 3
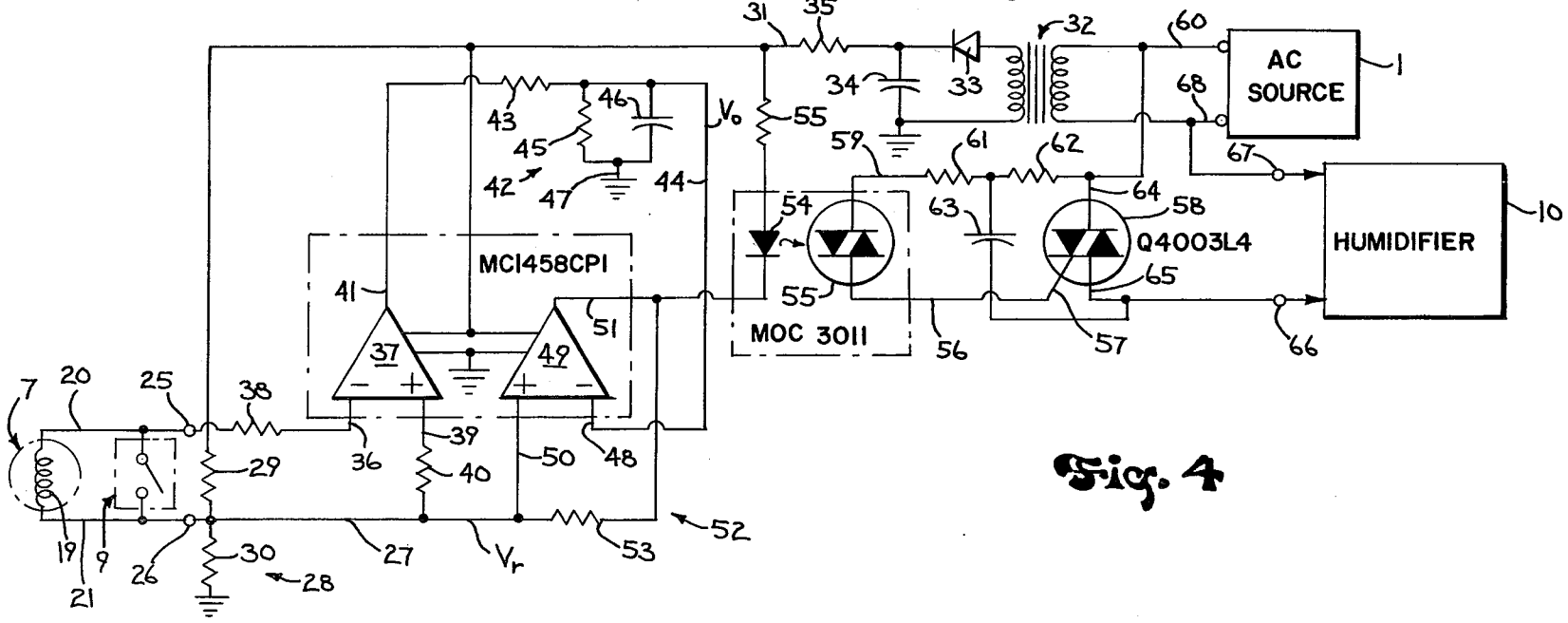
Fig. 4

HUMIDIFIER CONTROL

BACKGROUND OF THE INVENTION

This invention relates to a control for a humidifier which is selectively operated to control the moisture in an air movement system in response to sensed electrical energy supplied to the air movement system.

Controls for air humidifiers have been designed to energize both a blower motor which conducts air through a circulating system and a humidifier which controls the moisture in the circulated air, such as illustrated in U.S. Pat. No. 3,840,001, which permits the blower to run for a period of time after the humidifier is shut off.

Various systems have sensed the current flow between a power source and a furnace blower for controlling the operation of a humidifier. On such system generally requires the severing of one or more connecting leads to directly electrically connect a primary of a sensing transformer having a secondary connected to operate a solenoid operated electro-mechanical switch having switching contacts for energizing the humidifier in response to the energization of the blower. When such blower motors are employed at higher operating speeds such as in conjunction with air conditioners, current transients are frequently encountered which may burn out or destroy such a sensing transformer.

Other systems have coiled one of the blower motor leads about an iron core associated with a current sensing coil to operatively energize and electro-magnetic relay to operate normally open contacts for energizing the humidifier.

Such prior systems which have slaved the humidifier operation to the operation of the blower have either interrupted or disfigured the blower lead being sensed and employ electro-mechanical relays which are subject to contact bounce and possible spurious operation due to external energy transients.

SUMMARY OF THE INVENTION

This invention relates to a control for a humidifier connected to an air movement system operatively receiving electrical energy through an energy conducting circuit for conducting air to a designated area and controlling the moisture in the conducted air.

An energy sensor provides a closed loop flux conducting circuit which is connected to surround in electrical isolation at least one lead of the energy conducting circuit and generates a magnetic flux signal in response to the energy flow through the conducting circuit. The sensor is thus removably connected to the conducting lead without disrupting or disfiguring such lead. The control includes an input which is connected to operatively respond to the flux signal flowing through the closed loop circuit and provides an output connected to operatively energize the humidifier for operation in response to the magnetic flux signal.

The closed loop flux conducting circuit includes a portion which is selectively movable between a first position establishing the closed loop flux conducting circuit and a second position establishing an open loop for permitting the sensor to be removably connected to surround the conducting circuit lead. A coil surrounds a portion of the flux conducting circuit and operatively provides an output signal to the control circuit input for energizing the humidifier in response to the generated magnetic flux signal. Electrical insulation maintains the sensed conducting circuit lead in electrical isolation from the flux conducting circuit.

The energy sensor immediately responds to sensed energy flow through the conducting circuit to provide an output. A time delay circuit includes an input connected to operatively respond to the energy flow indicative output while a delay circuit output is connected to operatively energize the humidifier for operation at a second time following the first time when the sensor was initially energized. Such time delay is extremely desirable in preventing spurious operation of the humidifier due to undesirable transients which may occur within the conducting circuit.

The time delay circuit provides an amplifier having an input connected to operatively respond to the energy flow indicative output while the amplifier output provides a constant magnitude signal whenever the energy flow indicative output exceeds a predetermined threshold magnitude. An integrating circuit responds to the constant magnitude amplifier signal and provides an integrated time delay output at the second, delayed time for operatively energizing the humidifier.

An opto-isolating circuit electrically isolates the humidifier energizing circuit from the sensor for maintaining reliable operation. Such opto-isolating circuit includes an input which is optically coupled to the output.

The opto-isolating circuit is particularly desirable wherein its output is coupled to operate a power switching circuit which couples the amplifier to the energy source for conducting a second magnitude current which is substantially greater than the sensor output which provides a first, lower magnitude current. Such opto-isolating circuit operates to supply gating pulses to a triac effectuating the power switching operation.

The system of the invention provides a highly reliable operation which is easy and economical to install with any existing air movement energizing electrical circuit without disrupting or disfiguring such existing circuit. The sensor eliminates the requirement of physically attaching the sensor to the conducting circuit such as at a high potential terminal box or the like. The sensor in operation does not draw any appreciable power from the energy conducting circuit being monitored. The control is highly sensitive for precise current sensing while insensitive to noise or other circuit disrupting conditions.

BRIEF DESCRIPTION OF THE DRAWING

The drawing furnished herewith illustrates a preferred construction of the present invention in which the above advantages and features are clearly disclosed, as well as others which will be clear from the following description.

In the drawings:

FIG. 1 is a diagrammatical block illustration of a system which controls the operation of a humidifier in response to the sensed flow of energy between a source and a furnace blower motor;

FIG. 2 is a perspective view of a sensor used in the apparatus of FIG. 1 for magnetically sensing the energy conducted between the power source and the furnace blower motor;

FIG. 3 is an exploded view of the sensor of FIG. 2; and

FIG. 4 is an electrical circuit schematic which operatively connects the power source to the humidifier in response to the output of the sensor.

DESCRIPTION OF THE PREFERRED ILLUSTRATED EMBODIMENT

Referring to the drawing and particularly FIG. 1, a power source 1 is connected to supply alternating current electrical power to a furnace blower motor 2 through a connecting circuit 3. In certain constructions, the connecting circuit may comprise only two leads such as a power conducting lead 4 and a ground or return lead 5. In other constructions, the furnace blower motor 2 may be operated at two or more speeds thus requiring additional power connecting leads for increased power such as illustrated by lead 6 in FIG. 1. For example, lead 4 may be energized for a low speed heating sequence while lead 6 may be energized for a high speed air conditioning sequence.

An energy sensor 7 monitors the energy flow through the connecting circuit 3 and provides an output to a humidifier control 8 in response to the sensed energy flow. The humidifier control 8 also responds to a humidistat sensor 9 which may be located within a room or area which receives the circulated air from the furnace blower motor 2. The humidifier control 8 thus responds to both the sensed energy in connecting circuit 3 and the humidistat 9 and selectively controls the energy flow between a power source such as 1 or any other power source and a humidifier 10. The humidifier 10 may be constructed in any desirable manner, and one type of desirable humidifier is shown in U.S. Pat. No. 3,193,259 to J. M. Liebmann.

In operation, the furnace blower motor 2 and humidifier 10 operate in conjunction as controlled by the humidifier control 8 for supplying air having the requisite humidity to a room or other area. Normally, humidifier operation is generally required during the heating season wherein the furnace blower motor 2 is operated solely through the low power conducting lead 4. The high power conducting lead 6 is generally used during the air conditioning season when a humidifier operation is not required. It is therefore generally unnecessary to sense the energy flow through lead 6 although such sensing could be incorporated within the invention if desired.

The energy sensor 7 is shown in greater detail in FIGS. 2 and 3 and includes a U-shaped bracket 11 formed from a good magnetic flux conducting material. Sensor 7 provides a base portion 12 and a pair of spaced, outwardly directed legs 13, each containing a stud receiving opening. An electrical insulating member 14 such as from foamed plastic or the like abuts the base portion 12 and is located between the spaced legs 13.

A bobbin type coil assembly 15 includes an H-shaped core 16 having an internal opening 17 which removably retains a threaded securing stud 18. The stud 18 may comprise a bolt, screw or the like, and provides good magnetic flux conducting characteristics. The H-shaped core 16 provides an outer circumferential surface which retains a coil 19 having a pair of output leads 20 and 21. Generally, the coil 19 is surrounded by an appropriate insulating cover (not shown).

An electrical insulating member 22 of plastic foam or the like abuts a portion of the H-shaped core 16 and coil 19. In addition, the member 22 removable abuts the insulating member 14 and sandwiches lead 4 therebetween. In such manner, the lead 4, which includes an electrical conductor 23 surrounded by an insulating cover 24, is spaced and insulated from both the coil 19 and the metal U-shaped member 11.

The sensor 7 may be readily disassembled by disengaging the U-shaped bracket 11 from the coil form 16 by removing the bolt or screw 18. The lead 4 thus may be easily inserted between the insulating members 14 and 22 for a sensing operation. The attachment of sensor 7 to lead 4 is accomplished quickly and simply without requiring any separation or penetration of the lead 4. The sensor 7 is more fully shown in the co-pending application of Thomas P. Fowler entitled Energy Sensor, filed on Mar. 19, 1979 and having Ser. No. 21,721 and is incorporated by reference herein. The sensor 7 is also shown in the co-pending application of Thomas P. Fowler entitled Load Indicator For An Air Cleaner filed on Mar. 19, 1979 and having Ser. No. 21,720 and is incorporated by reference herein.

The humidifier control 8 is specifically illustrated in FIG. 4. The lead 20 of sensor 7 is connected to an input terminal 25 while the lead 21 is connected to an input terminal 26. The humidistat 9 is shown as a normally open switch and is also connected to the input terminals 25 and 26 and in parallel to the coil 19 of sensor 7. The open circuit condition of humidistat 9 indicates that humidification is required to be added to the air being circulated by the furnace blower motor 2. When added humidification is no longer required, humidistat 9 closes to effectively provide a short circuit across the sensor coil 19.

A D.C. reference voltage $V_r$ is established at a reference lead 27. Such D.C. reference voltage is supplied through a voltage divider circuit 28 including resistors 29 and 30, with resistor 29 connected to a D.C. bias source lead 31 and the resistor 30 connected to a system ground. The lead 27 is connected to the juncture between the voltage dividing resistors 29 and 30. A constant magnitude D.C. voltage is provided at the lead 31 from a conventional A.C. to D.C. rectifying and filter circuit including the A.C. energy source 1, a transformer 32, a rectifying diode 33, a capacitor 34, and a resistor 35.

The input terminal 25 is connected to an inverting input 36 of a high gain operational amplifier 37 through a connecting resistor 38. The input terminal 26 is connected to a non-inverting input 39 of amplifier 37 through the reference voltage lead 27 and an input resistor 40. Generally, the resistance of input resistor 40 is substantially greater in magnitude than the resistance of input resistor 38. An output circuit 41 of amplifier 37 is connected to an integrating circuit 42 which is constructed to provide a time delay in the circuit operation. Specifically, the time delay circuit 42 includes an input resistor 43 connected in series circuit with the output 41 of amplifier 37. An output circuit 44 of the time delay circuit 42 is serially connected to resistor 43 while a resistor 45 and a capacitor 46 are connected in parallel to each other and connect lead 44 to the system neutral or ground 47.

The output 44 of the time delay circuit 42 is connected to an inverting input 48 of an operational amplifier 49. A non-inverting input 50 of amplifier 49 is connected to the reference voltage lead 27. An output circuit 51 of amplifier 49 is connected to the non-inverting input 50 through a feedback circuit 52 which includes a feedback resistor 53. The amplifiers 37 and 49 operate as high gain operational amplifiers and may be commercially purchased in an integrated package, such as marketed by the Motorola Semiconductor Products, Inc. under the designation MC1458CP1.

A light emitting diode 54 has an anode circuit connected to the D.C. voltage source lead 31 through a resistor 55 while a cathode circuit is connected to the output 51 of operational amplifier 49. The photo-diode 54 is spaced in close proximity to a light sensitive photo-thyristor 55, operating as a triac, with diode 54 and photo-thyristor 55 commercially available in an integrated package, such as sold by Motorola Semiconductor Products, Inc. under the commercial designation MOC 3011.

An output 56 of photo-thyristor 55 is connected to a gate circuit 57 of a triac 58. Another output 59 of photo-thyristor 55 is connected to an output circuit 60 provided by the A.C. source 1 through a pair of serially connected resistors 61 and 62. A capacitor 63 is connected between the juncture of resistors 61 and 62 and the output terminal 65 of triac 58. The triac 58 provides one terminal 64 which is connected to the A.C. source lead 60 while another terminal 65 is connected to an output terminal 66. Another output terminal 67 is connected to an output lead 68 provided by the A.C. source 1. The output terminals 66 and 67 of humidifier control 8 are connected to supply an energizing input to humidifier 10.

To describe the operation, it is initially presumed that humidistat 9 sensed that humidification is required in the monitored room or area and switch 9 is in an opened condition as illustrated in FIG. 4. With the furnace blower motor 2 in a deactivated condition, no energy will flow through connecting circuit 3 and coil 19 of sensor 7 will provide a constant reference signal at input terminals 25 and 26 thereby indicating a quiescent, deactivated condition of the system.

In such a deactivated state, a reference or first voltage signal $V_{r1}$, such as approximately 7.9 volts D.C. for example, will appear at reference lead 27. In that the resistance of resistor 40 is much larger than the resistance of resistor 38, the quiescent signal at input 39 will be slightly smaller than the quiescent signal at input 36 and the amplifier 37 will be maintained in a "turned-off" condition to provide a logic "0" or system ground potential signal at output 41. The timing circuit 42 will thus be in a quiescent, discharged state and the signal $V_o$ at output 44 will be at the logic "0" or the system ground potential. The signal at input 50 of amplifier 49, namely $V_{r1}$, will have a greater magnitude than the signal $V_o$ appearing at input 48 to maintain the amplifier 49 in a "turned-on" state. With amplifier 49 maintained "turned-on", a logic "1" signal appears at output 51 and has sufficient magnitude to reverse bias the photo-diode 54 thereby rendering the photo-diode 54 in a non-conducting state. The photo-thyristor 55 and the triac 58 will remain non-conductive and the output terminals 66 and 67 will remain operatively disconnected from the power source 1.

When the blower motor 2 is energized by source 1, A.C. electrical energy will flow through the connecting circuit 3. If the low power lead 4 is energized, sensor 7 will respond and provide a power indicative signal to the control 8. Specifically, the flow of A.C. electrical energy through connecting lead 4 will induce a proportional magnetic flux within a closed loop path including the U-shaped bracket 11 and securing screw 18. The coil 19, in turn, will generate an A.C. electrical signal, such as thirty milli-volts A.C. for example, which is directly proportional to the flux flow through the securing screw 18 and thus proportional to the energy flow through lead 4.

During a half-cycle portion of the alternating signal provided by sensor 7, the non-inverting input 36 will become sufficiently greater than the signal at input 39 to turn amplifier 37 "on". As an example, the coil 19 may be constructed to supply an A.C. signal with a magnitude of thirty milli-volts of peak energy in response to sensed current flow while about ten milli-volts are sufficient to turn amplifier 37 "on". The output 41 of amplifier 37 thus transfers from the logic "0" or system ground level to a logic "1" level, such as 10 volts for example. With the amplifier 37 being "turned-on" periodically during alternate half-cycles of the A.C. signal provided by sensor 7, capacitor 46 begins to charge. Thus during a sensing operation, the A.C. signal output of coil 19 is transformed into a square wave of constant magnitude at output 41. Such square wave output retains its constant magnitude even though the peak A.C. output may vary. In that the time constant of the delay circuit 42 is much greater than the input frequency of the A.C. signal provided by sensor 7, a short delay, such as approximately one second for example, occurs while the output signal $V_o$ at lead 44 rises to and exceeds the reference voltage $V_{r1}$. When the signal $V_o$ at input 48 sufficiently exceeds the reference signal $V_{r1}$ appearing at input 50, the operational amplifier 49 will "turn-off" and the output 51 will transfer from a logic "1" level to a logic "0" or ground level, the photo-diode 54 is no longer reverse-biased and a conducting circuit is established from the D.C. source lead 31, resistor 55, the photo-diode 54 and the system ground as established at output 51 of the "turned-off" amplifier 49.

The energization of the photo-diode 54 in response to sensed energy flow through lead 4 results in the generation of light in the infrared or other suitable wave length range which is sensed by the photo-thyristor 55 to turn-on and provide a gating signal to the triac 58. The triac 58 "turns-on" and operatively connects the A.C. source 1 to supply operating power to the output terminals 66 and 67 for energizing the humidifier 10. In such manner, sufficient operating power of significant magnitude is supplied to humidifier 10 to operate fans and/or pump motors and/or control solenoids and perhaps other operating circuitry to effect humidifier operation.

With amplifier 49 "turned-off" to supply a logic "0" or system ground signal at output 51, the reference voltage $V_r$ at the reference lead 27 will decrease from a first magnitude D.C. reference voltage level $V_{r1}$, such as 7.9 volts D.C. for example, to a second magnitude D.C. reference voltage level $V_{r2}$, such as 3.3 volts D.C. for example.

The establishment of a second, substantially lower reference voltage $V_{r2}$ provides a delay in de-energizing the photo-diode 54 in response to the de-energization of the sensor coil 19. Thus if energy ceases to flow through lead 4, the amplifier 37 will "turn-off" to provide a logic "0" or system ground signal at output 41. The time delay circuit 42, however, will maintain an output signal $V_o$ of sufficient magnitude for a pre-established time period, such as one second for example, to maintain the amplifier 49 "turned-off" and photo-diode 54 in a conducting state. Following the predetermined time period as established by the discharge time of capacitor 46, the signal $V_o$ decreases to less than the second reference voltage $V_{r2}$ thereby turning amplifier 49 "on" to reverse-bias the photo-diode 54. The output terminals 66 and 67 are thus operatively disconnected from the source 1.

Such delay in de-activating the humidifier 10 following the interruption of energy flow through lead 4 is extremely desirable for reliable and efficient operation. For example, a transient type of fault or other brief interruption in power through lead 4 will not produce any interruption of power to the humidifier 10.

The delay in activating the humidifier 10 following initiation of energy flow through lead 4 likewise is extremely desirable for reliable and efficient operation. For example, a sensed transient flowing through lead 4 will not erroneously activate the humidifier 10.

When added humidity is not required, the humidistat 9 will close its contacts and maintain the amplifier 37 "turned-off". The amplifier 49 will be maintained in a "turned-on" condition to reverse-bias the photo-diode 54 and the humidifier will be maintained in a de-activated state irregardless of whether or not energy is flowing through lead 4.

The system provides a highly desirable manner of sensing a substantial energy flow in one power conducting circuit for the purpose of supplying large amounts of power in another operating circuit in response to the sensed operation of the first power operating circuit. Such sensing is accomplished without physically breaking into the sensed continuous power conducting circuit or without penetrating the insulation surrounding such sensed power conducting circuitry. The system employs a relatively small magnitude power indicative signal which is developed in response to the sensed power flow in the primary circuit for a highly sensitive control. Predetermined time delays are provided to prevent unwanted operation which might otherwise be caused by power transients or faults in the main power conducting circuit. The photo-isolation within the circuit provides a highly isolated control which is not falsely activated by transients in the A.C. source 1 or which may otherwise be generated by humidifier 10.

Various modes of carrying out the invention are contemplated as being within the scope of the following claims particularly pointing out and distinctly claiming the subject matter which is regarded as the invention.

I claim:

1. A control for a humidifier connected to an air movement system operatively receiving electrical energy through an energy conducting circuit for conducting air to a designated area and controlling the moisture in said conducted air, said control comprising energy sensor means including a closed loop flux conducting circuit having a portion selectively movably between a first position establishing said closed loop flux conducting circuit and a second position establishing an open loop for permitting said sensor means to be removably connected to surround in electrical isolation at least one lead of said energy conducting circuit and generating a magnetic flux signal in response to the energy flow through said connecting circuit and providing an output signal occurring at a first time substantially at the start of energy flow through said energy conducting circuit, and time delay means having an input connected to operatively respond to said energy flow indicative output signal and an output connected to operatively energize said humidifier for operation at a second time following said first time by a predetermined time delay in response to said energy flow indicative output signal.

2. The control of claim 1, wherein said time delay means includes an amplifier having an input connected to operatively respond to said energy flow indicative output and an output providing a constant magnitude signal whenever said energy flow indicative output exceeds a predetermined threshold magnitude, and integrating means responding to said constant magnitude amplifier signal and providing an integrated time delayed output at said second time for operatively energizing said humidifier.

3. A control for a humidifier connected to an air movement system operatively receiving electrical energy through an energy conducting circuit for conducting air to a designated area and controlling the moisture in said conducted air, said control comprising energy sensor means including a closed loop flux conducting circuit having a portion selectively movably between a first position establishing said closed loop flux conducting circuit and a second position establishing an open loop for permitting said sensor means to be removably connected to surround in electrical isolation at least one lead of said energy conducting circuit and generating a magnetic flux signal in response to the energy flow through said connecting circuit and transferring from a first output indicating the flow of energy through said energy conducting circuit to a second output different than said first output and indicating the absence of energy flow through said connecting circuit, time delay means having an input connected to operatively respond to said second sensor means output and an output connected to operatively de-energize and humidifier following a predetermined time delay after the transfer from said first sensor means output to said second sensor means output.

4. A control for a humidifier connected to an air movement system operatively receiving electrical energy through an energy conducting circuit for conducting air to a designated area and controlling the moisture in said conducted air, and control comprising energy sensor means including a closed loop flux conducting circuit having a portion selectively movably between a first position establishing said closed loop flux conducting circuit and a second position establishing an open loop for permitting said sensor means to be removably connected to surround in electrical isolation at least one lead of said energy conducting circuit and generating a magnetic flux signal in response to the energy flow through said connecting circuit, and opto-isolating means having an input optically coupled to an output with said input connected to operatively respond to said sensor means flux signal and said output electrically isolated from said energy sensor means and connected to operatively energize said humidifier for operation in response to said energy flow indicative output.

5. The control of claim 4, wherein said sensor means output constitutes a first magnitude current, and including a power switching circuit coupling said humidifier to said energy source means and having an input operatively connected to said opto-isolating means output for conducting a second magnitude current substantially greater in magnitude than said first magnitude current to operatively energize said humidifier.

6. The control of claim 5, wherein said switching circuit includes a triac having a gate circuit connected to said opto-isolating means output.

7. A control for a humidifier connected to an air movement system operatively receiving electrical energy through an energy conducting circuit for conducting air to a designated area and controlling the moisture in said conducted air, said control comprising energy sensor means including a closed loop flux conducting circuit removably connected to surround at least one lead of said energy conducting circuit and generating a magnetic flux signal at a first time substantially at the start of energy flow through said connecting circuit, amplifying means having an input connected to operatively respond to said flux signal and an output providing a command signal at a second time following said first time by a predetermined time delay, and opto-isolating means having an input optically coupled to an output with said input connected to operatively respond to said command signal and said output electrically isolated from said energy sensor and amplifying means and connected to operatively energize said humidifier for operation in response to said command signal.

8. The control of claim 7, wherein said closed loop flux conducting circuit includes a portion selectively movable between a first position establishing said closed loop flux conducting circuit and a second position establishing an open loop for permitting said sensor means to be removably connected to surround said circuit lead without damaging said lead.

9. A control for a humidifier connected to an air movement system operatively receiving electrical energy through an energy conducting circuit for conducting air to a designated area and controlling the moisture in said conducted air, said control connected to monitor the energy flow in said energy conducting circuit and to operatively connect said humidifier to said source means for selectively supplying operatively energy to said humidifier, said control means including an energy sensor including a closed loop flux conducting circuit removably surrounding at least one lead of said energy conducting circuit and generating a magnetic flux signal in response to the energy flow through said conducting circuit and a coil surrounding a portion of said flux conducting circuit and generating an electrical signal in response to said flux signal, a first amplifier having an input connected to receive said electrical signal from said coil and an output transferring from a first signal to a second signal in response to said electrical signal, time delay circuit means having an input connected to receive said first and second signals and an output providing a delay signal at a predetermined time following the occurrence of said second signal, a second amplifier having an input connected to receive said delay signal and an output providing an energizing signal in response to said delay signal, opto-isolating means including a light emitter connected to said second amplifier output and emitting light in response to said energizing signal and a light response switch having an input located adjacent said light emitter and an output providing a connect signal in response to sensed light from said light emitter, and connect means having a first input connected to said light responsive switch output and a second input connected to said energy source means and an output connected to said humidifier for operatively connecting said energy source means to said humidifier in response to said connect signal.

10. The control of claim 9, wherein said second amplifier has a second input operatively connected through a feed back circuit to second amplifier output and providing a first reference signal input in response to the absence of said energizing signal and a second reference signal input in response to the presence of said energizing signal, said second amplifier maintaining said energizing signal for a predetermined time and maintaining said operative connection between said energy source means and said humidifier for said predetermined time following the transfer of said first amplifier output from said second signal to said first signal in response to the absence of said electrical signal from said sensor coil.

* * * * *